US012311279B2

(12) United States Patent
Nigro

(10) Patent No.: US 12,311,279 B2
(45) Date of Patent: May 27, 2025

(54) METHODS AND APPARATUS FOR STUFFABLE PLUSH TOY

(71) Applicant: JINGLE BUNNIES LLC, Las Vegas, NV (US)

(72) Inventor: Ryanne Nigro, Las Vegas, NV (US)

(73) Assignee: JINGLES BUNNIES LLC, Las Vegas, NV (US)

( * ) Notice: Subject to any disclaimer, the term of this patent is extended or adjusted under 35 U.S.C. 154(b) by 124 days.

(21) Appl. No.: 18/061,431

(22) Filed: Dec. 3, 2022

(65) Prior Publication Data

US 2023/0102105 A1 Mar. 30, 2023

Related U.S. Application Data

(63) Continuation of application No. PCT/US2022/071887, filed on Apr. 23, 2022.

(60) Provisional application No. 63/181,385, filed on Apr. 29, 2021.

(51) Int. Cl.
*A63H 3/02* (2006.01)
*A63H 3/00* (2006.01)

(52) U.S. Cl.
CPC ..... *A63H 3/02* (2013.01); *A63H 3/005* (2013.01)

(58) Field of Classification Search
CPC ..... A63H 3/005; A63H 3/02
See application file for complete search history.

(56) References Cited

U.S. PATENT DOCUMENTS 2,347,405 A 4/1944 Ford
2,549,695 A 4/1951 Linder
3,099,568 A 7/1963 Ira et al.
(Continued)

FOREIGN PATENT DOCUMENTS

EP 0524325 A1 1/1993
JP 2001046750 A 2/2001
(Continued)

OTHER PUBLICATIONS

Chicco, Chicco Pocket Buddies Soft Pacifier Holder-Lovey, Soothing Plush Toy Animal (Dec. 10, 2020).
Nanco, Teddy Bear (Dec. 10, 2020).

*Primary Examiner* — John A Ricci
(74) *Attorney, Agent, or Firm* — Fishman Stewart PLLC; Cecily Anne O'Regan

(57) ABSTRACT

A stuffable toy is formed by providing a toy shell having several fabric members fastened together to form a desired stuffable toy shape (e.g., bear, dog, moose, cat, rabbit), thereby defining one or more interior chambers or cavities for receiving stuffing material. The one or more interior chambers define an exterior surface forming a shape of a stuffable toy when the interior chamber has stuffing material. The stuffable toy further has an exteriorly accessible chamber separate from the one or more interior chambers which has an opening that is not in communication with the one or interior chambers. A drawstring is provided within a channel formed about the opening of the chamber which attaches within a first appendage at a first end and a second appendage at a second end. Once a removable item is placed within the exteriorly accessible chamber, the drawstring can be tightened to close the opening and retain the removable item within the interior of the exteriorly accessible chamber.

14 Claims, 7 Drawing Sheets

(56) References Cited

U.S. PATENT DOCUMENTS

| | | | | |
|---|---|---|---|---|
| 4,563,159 | A * | 1/1986 | Hills | A63H 3/005 446/369 |
| 4,614,505 | A * | 9/1986 | Schneider | A63H 33/004 446/369 |
| 5,074,252 | A | 12/1991 | Morgan | |
| 5,146,875 | A | 9/1992 | Bolt | |
| 5,326,300 | A * | 7/1994 | Sonders | A45C 15/00 446/369 |
| 5,389,028 | A | 2/1995 | Cabrera et al. | |
| 5,855,276 | A * | 1/1999 | Smith, Jr. | A45C 13/08 190/111 |
| 5,980,496 | A | 11/1999 | Jacobsen et al. | |
| 6,325,475 | B1 | 12/2001 | Hayes et al. | |
| 6,343,968 | B1 * | 2/2002 | Louie | A47G 9/083 5/413 R |
| 6,350,169 | B1 | 2/2002 | Holt | |
| 6,547,633 | B2 | 4/2003 | Haug | |
| 6,604,490 | B1 | 8/2003 | Lee, IV et al. | |
| 7,169,008 | B2 | 1/2007 | Ritchey | |
| 7,780,972 | B2 | 8/2010 | Hurwitz | |
| 8,613,639 | B2 * | 12/2013 | Hengel | A63H 3/02 446/73 |
| 8,758,075 | B2 | 6/2014 | Rubinfeld | |
| 8,944,876 | B2 * | 2/2015 | Hengel | A63H 3/005 446/73 |
| 9,162,152 | B2 * | 10/2015 | Jimenez Schreck | A63H 3/003 |
| 2003/0077978 | A1 | 4/2003 | Beige | |
| 2004/0259464 | A1 | 12/2004 | Lien et al. | |
| 2006/0089076 | A1 * | 4/2006 | Jacobson | A63H 3/02 446/71 |
| 2007/0232186 | A1 | 10/2007 | Shamah | |
| 2008/0142624 | A1 | 6/2008 | Ivri et al. | |
| 2008/0220688 | A1 * | 9/2008 | Cuisinier | A63H 3/005 446/73 |
| 2010/0095896 | A1 | 4/2010 | Wye | |
| 2010/0155414 | A1 | 6/2010 | Hu | |
| 2011/0136466 | A1 | 6/2011 | Pan | |
| 2011/0139088 | A1 | 6/2011 | Gordon | |
| 2012/0329358 | A1 * | 12/2012 | Cupid | A63H 3/005 446/73 |
| 2015/0314205 | A1 * | 11/2015 | Rebella | A63H 33/004 446/73 |
| 2016/0302393 | A1 | 10/2016 | Pradeep et al. | |
| 2018/0065053 | A1 | 3/2018 | Brant | |

FOREIGN PATENT DOCUMENTS

| | | | |
|---|---|---|---|
| KR | 200287021 | Y1 | 8/2002 |
| KR | 20210000460 | U | 3/2021 |
| WO | 2016028029 | A1 | 2/2016 |
| WO | 2016204587 | A1 | 12/2016 |
| WO | 2017177094 | A2 | 10/2017 |
| WO | 2019083783 | A1 | 5/2019 |
| WO | 2019083820 | A1 | 5/2019 |
| WO | 2022232759 | A1 | 11/2022 |

* cited by examiner

METHODS AND APPARATUS FOR STUFFABLE PLUSH TOY

CROSS-REFERENCE

This application is a continuation of PCT application PCT/US2022/071887 filed Apr. 23, 2022, which claims the benefit of U.S. Provisional Application No. 63/181,385, filed Apr. 29, 2021, entitled METHODS AND APPARATUS FOR STUFFABLE PLUSH TOY which application is incorporated herein in its entirety by reference.

BACKGROUND

Field: The present disclosure relates to stuffable toys. More particularly, the disclosure relates to stuffed toys and a method of securing an unrelated item within an exteriorly accessible chamber or cavity that employs a drawstring partially positioned within a channel and controllable by appendages of the stuffed toy to control access to the chamber.

Background: Stuffed toys are popular among children. Stuffed toys typically include a soft inner material or stuffing such as foam or cotton which is held within an outer fabric shell or skin. The outer shell often has simulated fur. Commonly, the shape of an animal such as a dog with a body, legs, tail and a head. The soft physical quality of stuffed toys bring enjoyment and comfort to their owners.

Most stuffed toys are manufactured by first sewing a fabric shell together from multiple pieces of fabric. The fabric pieces are sewn together inside out, and then turned right side out so that any unsightly edges of the seams remain on the inside of the shell. Typically, an opening is left in the fabric through which stuffing may later be inserted into the shell. After stuffing, toys are typically sewn shut.

Oftentimes, stuffed toys are gifted in connection with a secondary gift, or item, such as a book or jewelry. However, there is no easy way to associate a secondary item with currently available stuffed animals. It would therefore be desirable to devise a stuffed toy and a method for forming a stuffed toy that includes an externally accessible stuffable chamber capable of holding a large quantity of items.

SUMMARY

A stuffable toy is formed by providing a toy having several fabric members fastened together to form a desired shape (e.g., doll, bear, dog, moose, cat, rabbit, etc.), thereby defining one or more interior chambers or cavities for receiving stuffing material to create a three dimensional shape. The stuffable toy has a permanent stuffing, such as poly-fil, cotton, polyester, wool, and goose down. The permanent stuffing can be replaceable but generally contributes to the overall three-dimensional shape of the stuffable toy. The one or more interior chambers define an exterior surface forming a shape of a stuffed toy when the interior chamber has stuffing material. Some components, may have less stuffing than other components, e.g., a tail. The stuffable toy further has an exteriorly accessible chamber or cavity separate from the one or more interior chambers containing the permanent stuffing which has an opening that is not in communication with the one or interior chambers. A drawstring is provided within a channel formed about the opening which attaches within a first appendage at a first end and a second appendage at a second end. Once a removable item is placed within the exteriorly accessible chamber, the drawstring can be tightened to close the opening and retain the removable item within the interior of the exteriorly accessible chamber.

The fabric for the outer facing members is selected from the group consisting of cloth, leather, suede, plush, fustian, velvet, mohair, worsted yarn, silk, cotton, polyester, terry cloth, Lycra, neoprene, fleece, and combinations thereof.

Both the foregoing general description and the following detailed description are exemplary and explanatory only and are not restrictive of the disclosed embodiments, as claimed.

INCORPORATION BY REFERENCE

All publications, patents, and patent applications mentioned in this specification are herein incorporated by reference to the same extent as if each individual publication, patent, or patent application was specifically and individually indicated to be incorporated by reference.

- JP Publication 2001/046750 A published Feb. 20, 2001 to Chin et al.;
- U.S. Pat. No. 2,347,405 A issued Apr. 25, 1944 to Ford;
- U.S. Pat. No. 2,549,695 A issued Apr. 17, 1951 to Linder;
- U.S. Pat. No. 3,099,568 A issued Jul. 30, 1963 to Ira et al.;
- U.S. Pat. No. 5,389,028 A issued Feb. 14, 1995 to Cabrera et al.;
- U.S. Pat. No. 6,350,169 B1 issued Feb. 26, 2002 to Holt;
- U.S. Pat. No. 6,547,633 B2 issued Apr. 15, 2003 to Haug;
- U.S. Pat. No. 7,169,008 B2 issued Jan. 30, 2007 to Ritchey;
- U.S. Pat. No. 8,758,075 B2 issued Jun. 24, 2014 to Rubinfeld;
- US Publication 2003/0077978 A1 published Apr. 24, 2003 to Beige;
- US Publication 2004/0259464 A1 published Dec. 23, 2004 to Lien et al.;
- US Publication 2006/0089076 A1 published Apr. 27, 2006 to Jacobson;
- NANCO, Teddy Bear (Dec. 10, 2020); and
- Chicco Pocket Buddies Soft Pacifier Holder-Lovey, Soothing Plush Toy Animal (Dec. 10, 2020).

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

I. Stuffable Toy

Disclosed is a stuffed toy. The stuffed to comprises: a textile outer sheath having a first side, a second side, and a hollow inner cavity between the first side and the second side, the textile outer sheath formed to substantially define a shape of the stuffable toy; a first panel attached to the first side of the outer sheath having a non-attached edge that defines a first opening forming a first pocket; a controller connected at a first end to a first interior location within a first appendage of the stuffed toy and connected at a second end to a second interior location within a second appendage of the stuffed toy; and a channel positioned at least partially within the first panel at a location near the first opening, wherein the controller passes partially through the channel and is operable to change the size of opening to the cavity when the appendages are pulled away from a central axis. The stuffed toy can have any suitable shape including an aardvark, an alligator, an American bison, a buffalo, an anteater, an antelope, an ape, an armadillo, a donkey, a baboon, a badger, a barracuda, a bear, a beaver, a bee, a bison, a boar, a bunny, a camel, a caribou, a cat, a cheetah, a chimpanzee, a chinchilla, a cow, a coyote, a deer, a dog, a dogfish, a dolphin, a donkey, an elephant, an elk, a fox, frog, a panda, a giraffe, a goat, a gorilla, a hippopotamus, a horse, a human, a hyena, a jackal, a jaguar, a kangaroo, a koala, a lemur, a leopard, a lion, a llama, a meerkat, a mink, a monkey, a moose, a mouse, a mule, an ox, a panther, a penguin, a pig, a pony, a rabbit, a raccoon, a ram, a rat, a red deer, a reindeer, a rhinoceros, a squirrel, a tiger, a wolf, wombat, a yak, and a zebra. Other shapes can be employed without departing from the scope of the disclosure. The stuffable toy has a permanent stuffing, such as poly-fil, cotton, polyester, wool, and goose down. The permanent stuffing can be replaceable but generally contributes to the overall three-dimensional shape of the stuffable toy. One or more exteriorly accessible cavities provide the opportunity to include removable items intended for temporary stuffing within the stuffable toy.

Figure 1B:
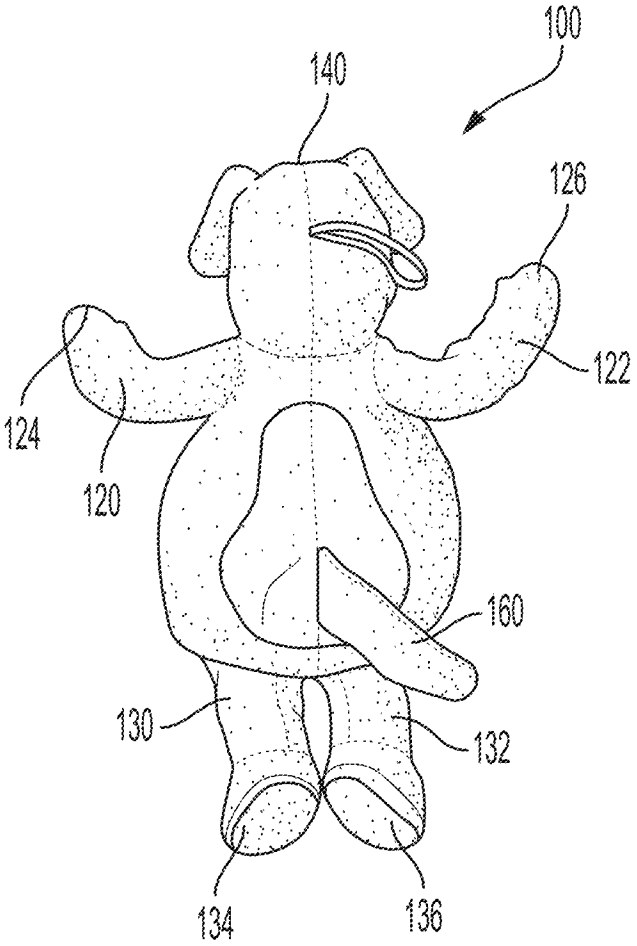
FIGS. 1A-D illustrate a front view, back view, and a stuffed view of an embodiment of a stuffable toy according to the disclosure.
Figure 1A:
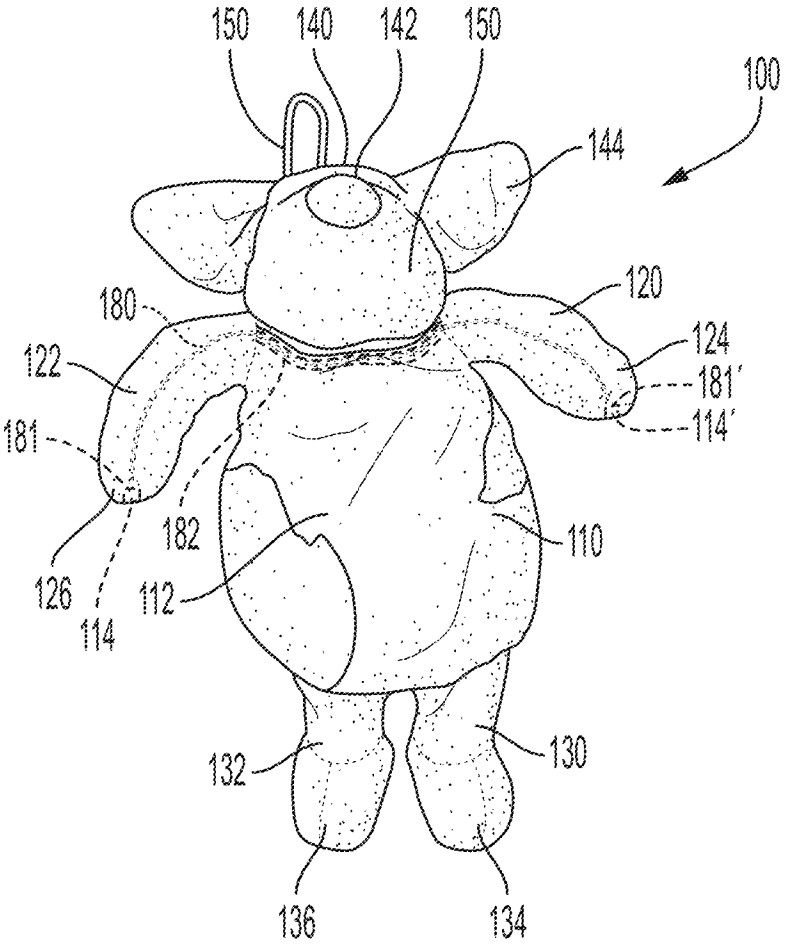
Figure 1D:
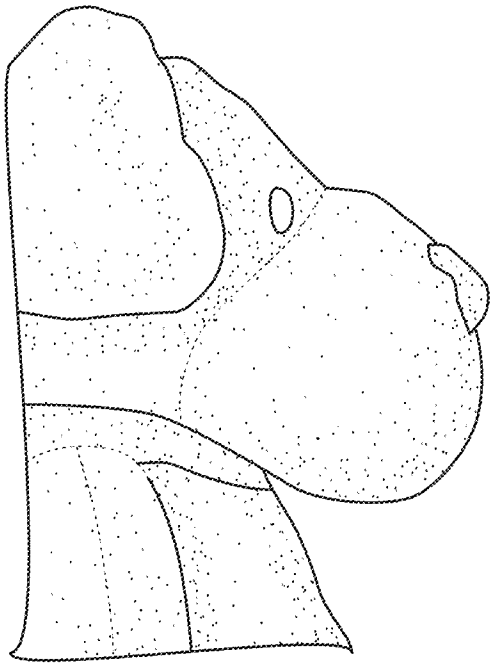
Figure 1C:
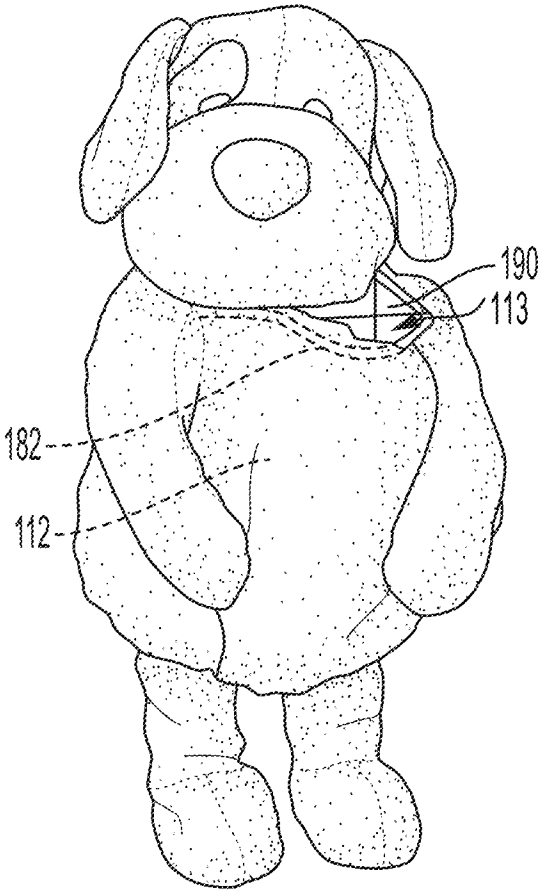

Turning now to a first embodiment illustrated in FIGS. 1A-D, FIG. 1A illustrates a front view of a stuffable toy 100, such as a dog, having a body 110. FIG. 1B illustrates a rear view of the stuffable toy 100. FIG. 1C illustrates a front view of the stuffable toy 100 with an item 190 removably positioned within a stuffable chamber 112 (pouch or cavity). FIG. 1D is a partial side view.

As will be appreciated by those skilled in the art, the stuffable toy 100 can have a plurality of colored panels associated with its exterior surface to reflect a variety of markings. A first pair of appendages 120, 122 are provided which have a length and a distal end 124, 126 (corresponding, for example, to a paw). A second pair of appendages 130, 132 are also provided. The second pair of appendages 130, 132, also have a distal end 134, 136. A head 140 is provided which as a nose 142, and ears 144. A loop 150 can be provided (illustrated extended above the top of the stuffable toy) which allows the stuffable toy 100 to be hung from a nail or a door knob. As will be appreciated from the rear view shown in FIGS. 1B and 2B, a tail 160 can also be provided as appropriate for the stuffable toy 100.

Spanning across at least part of the front of the stuffable toy 100 in this embodiment is a stuffable chamber 112 with an opening 113 near the head 140 of the stuffable toy 100. The stuffable chamber 112 is accessible via an opening (viewable in FIG. 1 C). A diameter of the opening is controllable via the first pair of appendages 120, 122. One or two controllers 180 is positioned within the appendages 120, 122 and through a channel 182 about an opening to the stuffable chamber 112. The one or two controllers have a first end and a second end secured respectively at a connection point 114, 114 within, for example, the first appendage and the second appendage and passing through a channel 182 at least positioned within the front opening of the stuffable chamber 112. When the appendages 120, 122 are pulled away from the body of the stuffable toy 100 (as shown in FIGS. 1 B and 2 B), the controller 180 acts as a drawstring and the opening for the stuffable chamber 112 gets smaller which allows an item 190 to be secured partially or fully within the stuffable chamber 112. In another configuration, not shown, the opening of the chamber is controlled via a controller that is accessed by the back of the animal instead of the appendages. The controller can be a ribbon, a rope, a fabric tie, a cord, an elastic cord, a fiber, a twine or a connector. Additionally, where there are two controllers, a channel containing a first controller can be provided on the body of the stuffed toy and a channel containing a second controller can be provided within opening of the stuffable chamber 112.

As will be appreciated by those skilled in the art, the stuffable chamber 112 can also be positioned on the rear surface of the stuffable toy 100 without departing from the scope of the disclosure. Additionally, and/or alternatively, the stuffable chamber 112 can be controllable via a different set of appendages. The stuffable chamber 112 has a volume of at least from 1800 $cm^3$ to 3000 $cm^3$, more preferably 2200 $cm^3$. The opening of the stuffable chamber 112 is sized to allow easy stuffing of the stuffable chamber 112 to include large items (such as fruit, 12 oz cans of soda, granola bars, protein bars, bags of chips, books, crayons, gift boxes, etc.). Pulling the appendages 120, 122 results in full or partial closure of the stuffable chamber 112. For example, when the stuffable chamber 112 is empty, the appendages 120, 122 are pulled to reduce the size of the opening to the stuffable chamber 112, whereas when the stuffable chamber 112 has received items, the appendages 120, 122 are pulled to tighten the opening around the items to reduce the likelihood that items will fall out, but may not close as completely as when the stuffable chamber 112 is empty.

Figure 2B:
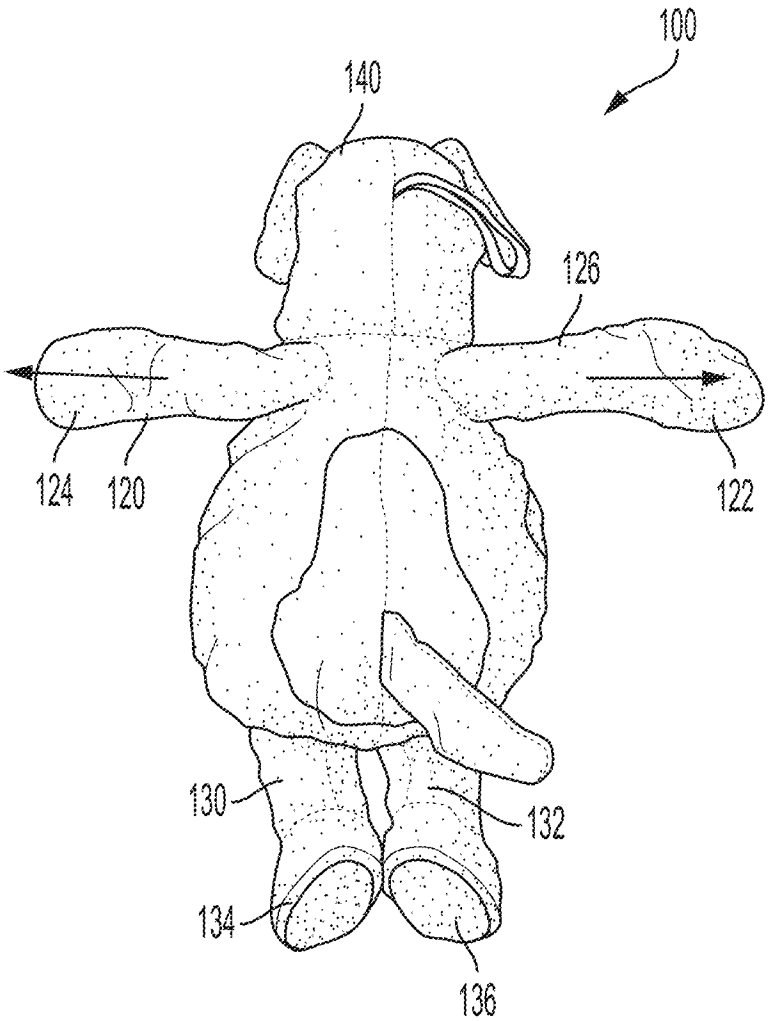
FIGS. 2A-B illustrate a front view, back view, and stuffed view of another embodiment of a stuffable toy according to the disclosure.
Figure 2A:
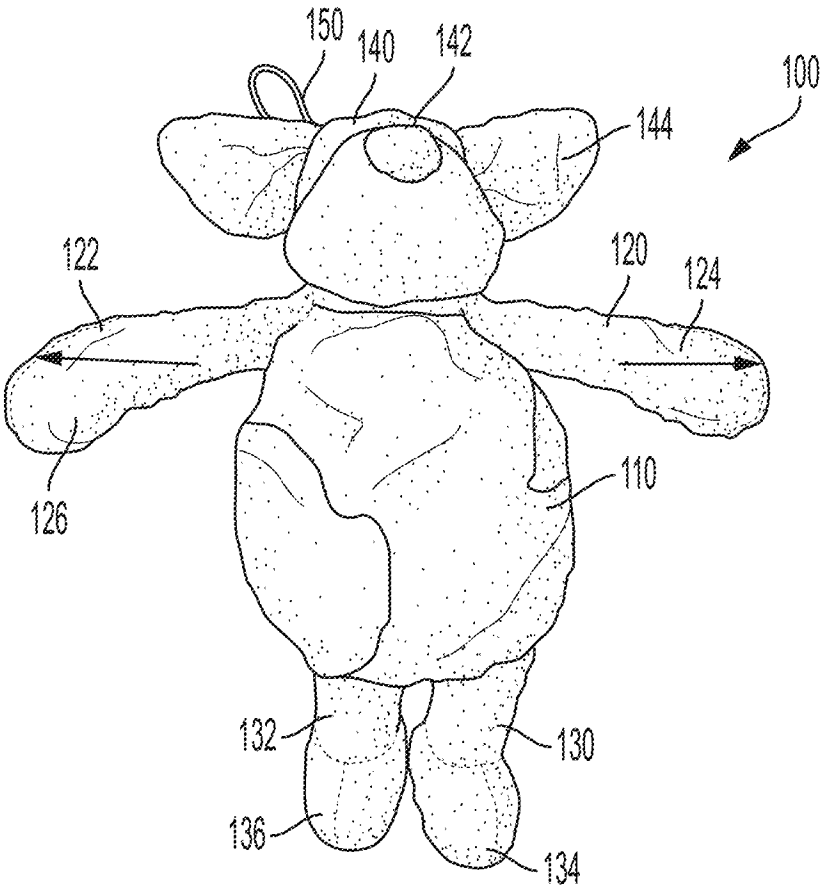

FIG. 2A-2B shows the stuffable toy 100 from the front and back with arrows indicating the arms being pulled away from a central axis of the stuffable toy. Pulling the opening to the stuffable chamber 112 shortens the appendages, while pulling the appendances 120, 122 reduces the size of the openings to the stuffable chamber 112.

Figure 3C:
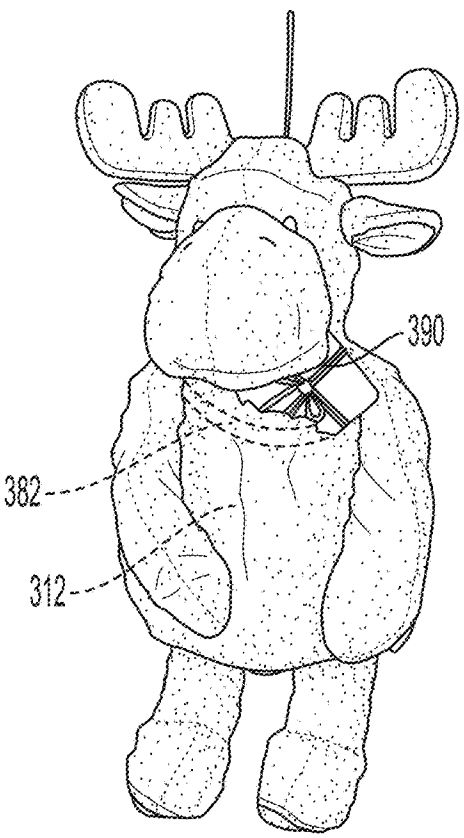
FIGS. 3A-C illustrate a front view, and a back view of the a stuffable toy of FIG. 1 according to the disclosure with the appendages pulled away from the body.
Figure 3B:
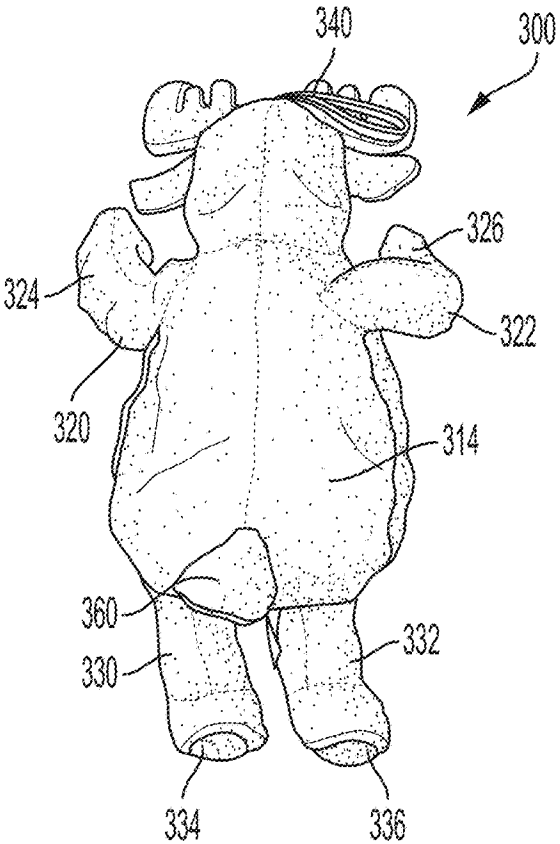
Figure 3A:
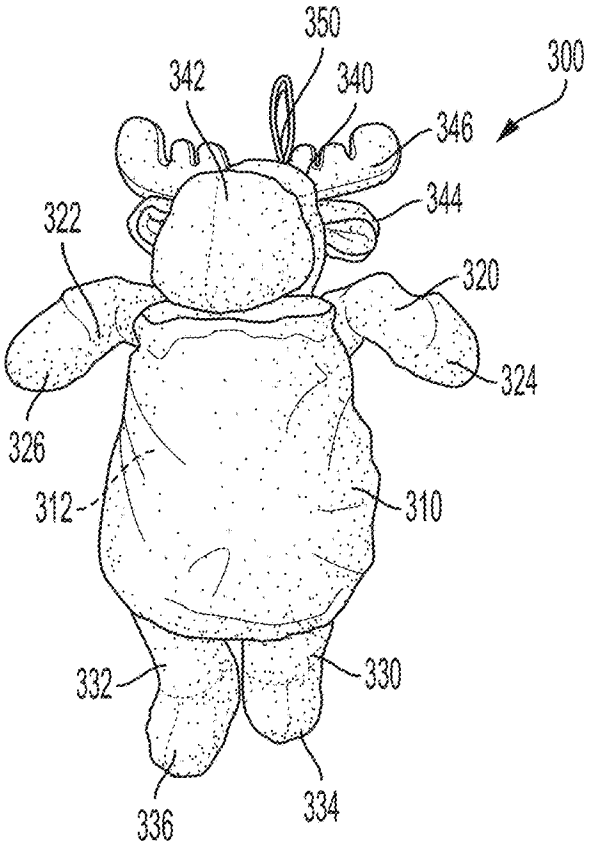
Figure 4B:
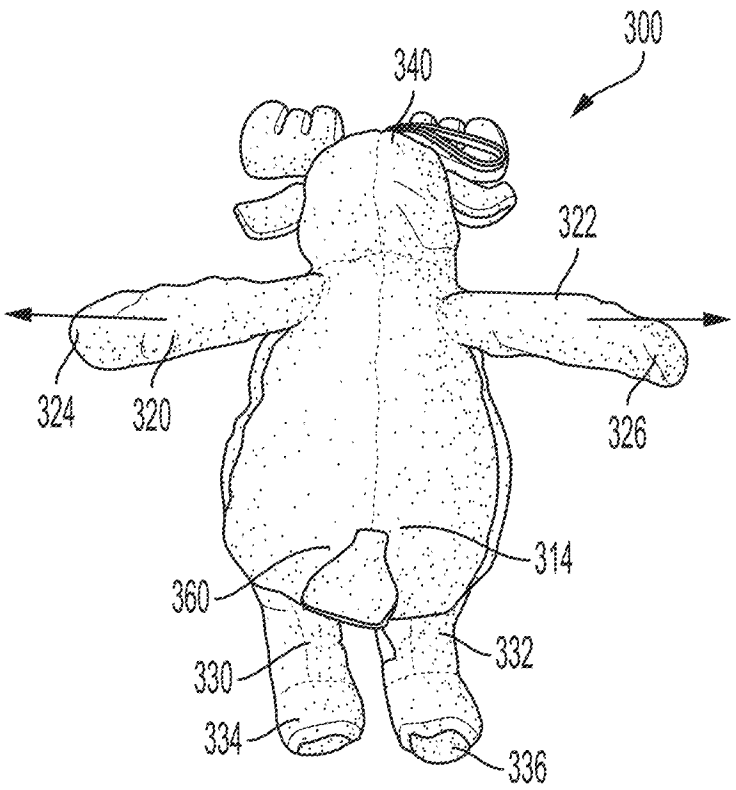
FIGS. 4A-B illustrate a front view, and a back view of the a stuffable toy of FIG. 2 according to the disclosure with the appendages pulled away from the body.
Figure 4A:
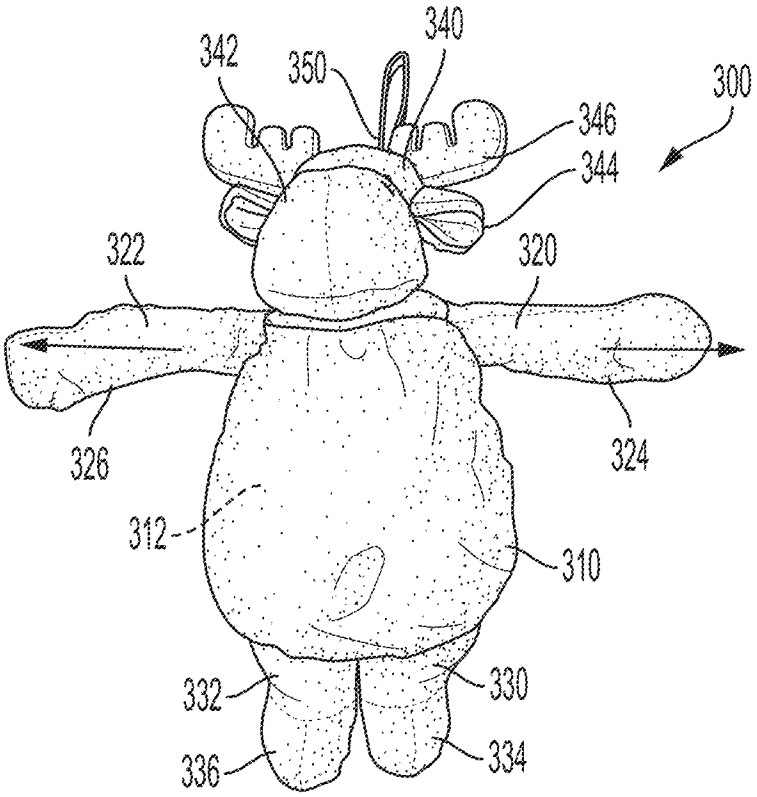

Turning now to a second embodiment illustrated in FIGS. 3A-C, FIG. 3A, FIG. 3C and FIG. 4A illustrate a front view of a stuffable toy 300, such as a moose, having a body 310. FIG. 3B and FIG. 4B illustrate a rear view of the stuffable toy 300. FIG. 3C illustrates a front view of the stuffable toy 300 with an item 390 removably positioned within a stuffable chamber 312 or pouch.

As will be appreciated by those skilled in the art, the stuffable toy 300 can have a plurality of colored panels associated with its exterior surface to reflect a variety of markings. A first pair of appendages 320, 322 are provided which have a length and a distal end 324, 326 (corresponding, for example, to a paw). A second pair of appendages 330, 332 are also provided. The second pair of appendages 330, 332, also have a distal end 334, 336. A head 340 is provided which as a nose 342, ears 344, and antlers 346. A loop 350 can be provided (illustrated extended above the top of the stuffable toy) which allows the stuffable toy 300 to be hung from a nail or a door knob. As will be appreciated from the rear view shown in FIGS. 3B and 4B, a tail 360 can also be provided as appropriate for the stuffable toy.

Spanning across at least part of the front of the stuffable toy 300 in this embodiment is a stuffable chamber 312 with an opening near the head 340 of the stuffable toy 300. The stuffable chamber 312 is accessible via an opening (viewable in FIG. 3C). A diameter of the opening is controllable via the first pair of appendages 320, 322. A controller 380 is positioned within the first pair of appendages 320, 322 and through a channel 382 within the exterior surface of the stuffable chamber 312. When the appendages 320, 322 are pulled away from the body of the stuffable toy 300 (as shown in FIGS. 3B and 4B), the opening for the stuffable chamber 312 gets smaller which allows an item 390 to be secured partially or fully within the stuffable chamber 312. As will be appreciated by those skilled in the art, the stuffable chamber 312 can also be positioned on the rear surface of the stuffable toy 300 without departing from the scope of the disclosure. Additionally, and/or alternatively, the stuffable chamber 312 can be controllable via a different set of appendages.

II. Method of Stuffing the Stuffable Toy

The disclosure includes a method of stuffing a stuffed toy. The method comprises providing a stuffed toy as disclosed herein; selecting one or more items to be placed in the first cavity; placing the one or more items into the first cavity; pulling the first appendage and the second appendage in opposite directions away from a central axis of the stuffable toy; and reducing the size of the opening to the chamber.

Figure 5D:
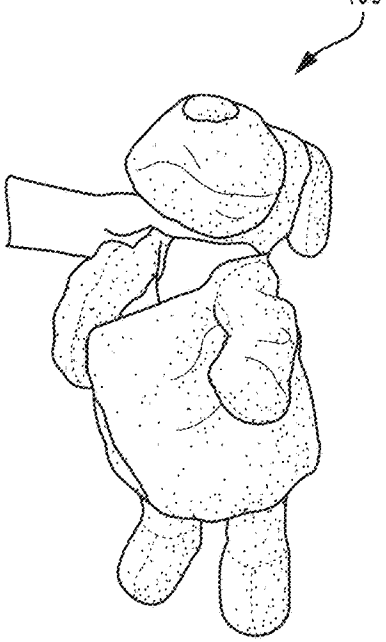
FIGS. 5A-H illustrate a progression of the embodiment of FIG. 1 from an unstuffed stuffable toy, through the stuffing process, and the final stuffed stuffable toy.
Figure 5C:
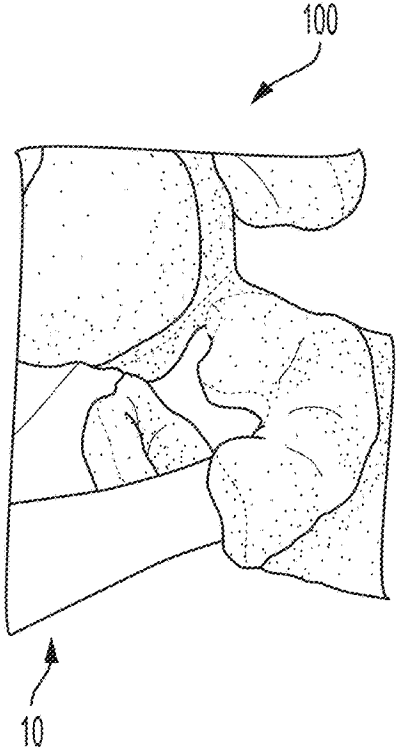
Figure 5B:
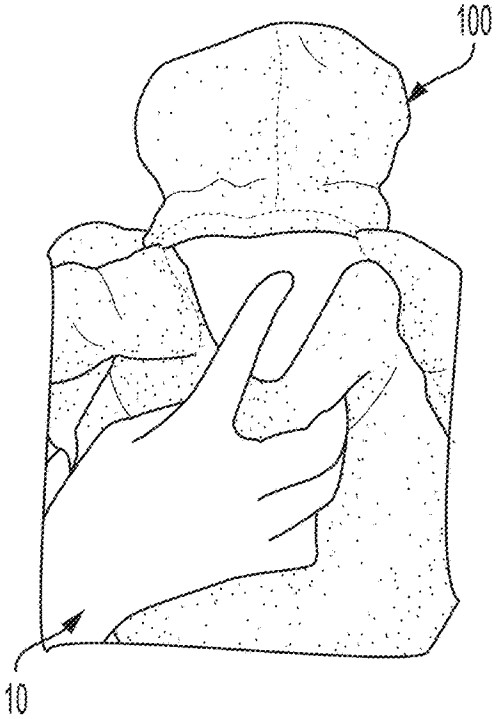
Figure 5A:
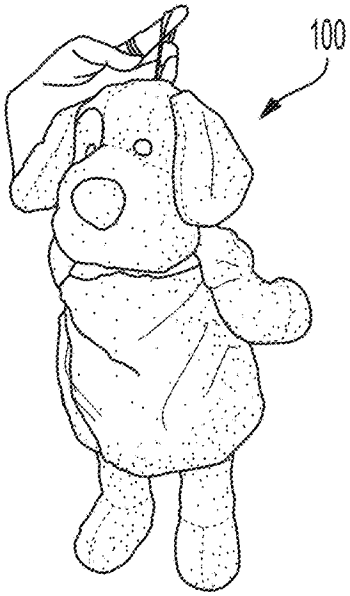

Turning now to FIGS. 5A-H, FIG. 5A illustrates a stuffable toy 100 prior to stuffing the stuffable chamber 112. The opening 113 to the stuffable chamber 112 is extended away from the body of the stuffable toy 100 and the appendages 120, 122 are shortened (extending about halfway down the body of the stuffable toy 100). In FIG. 5B, the opening to the chamber 112 is pulled away from the body of the stuffable toy 100. In this embodiment, the exterior body comprises a first fabric type while the interior surface of the chamber 112 comprises a second fabric type, different than the first fabric type. Suitable fabrics include, but are not limited to faux fur, velour, canvas, cotton, polyester, synthetic fibers, fleece, mink, faux suede, felt, flannel, jersey, and mesh. In one example, the first fabric type for the body could be a faux fur, while the second fabric for the interior surface of the chamber could be a flannel-like material. Additional, the fabrics can be of differing colors. For example, an exterior faux fur could be brown, while the interior flannel-like material is cream.

Figure 5H:
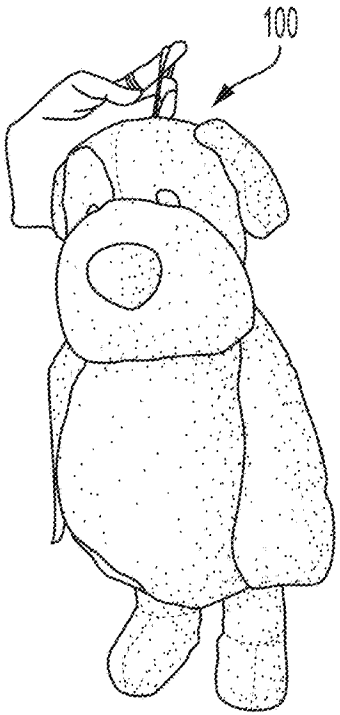
Figure 5G:
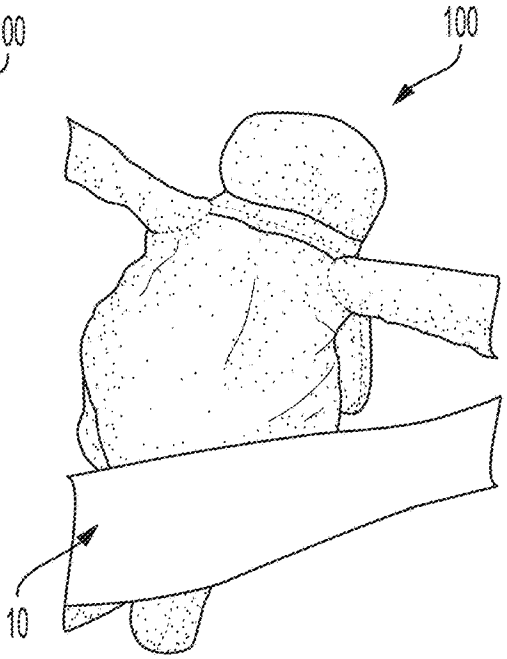
Figure 5F:
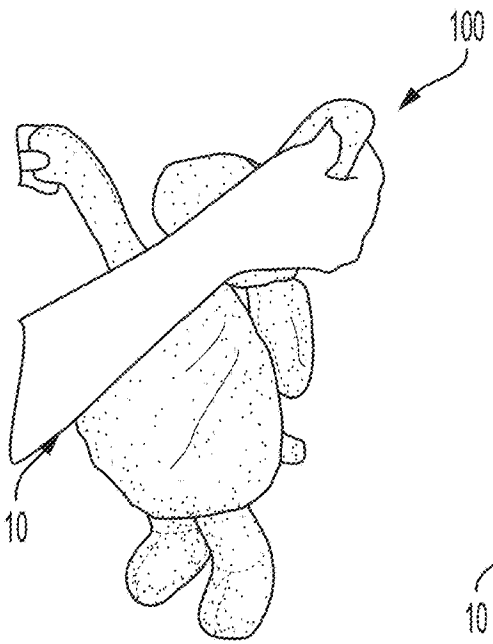
Figure 5E:
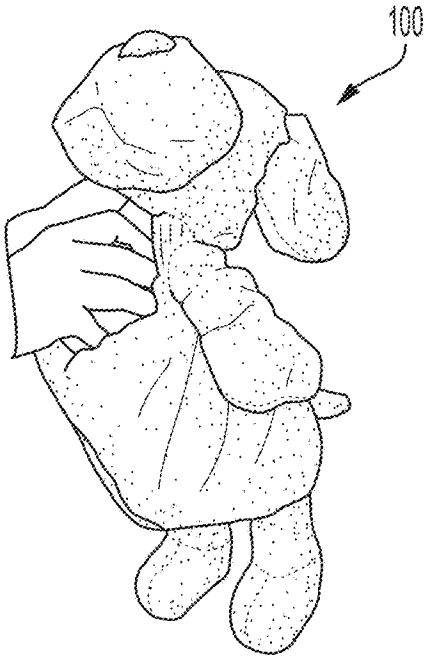

FIG. 5C illustrates a user's hand 10 entering the chamber 112 of the stuffable toy 100. FIG. 5D illustrates the opening 113 to the chamber 112 fully extended away from the main body of the stuffable toy 100. FIG. 5E illustrates a user 10 putting items (such as candy) into the chamber. FIG. 5F illustrates a user 10 beginning to pull the appendages 120, 122 controlling the chamber 112 opening away from the body of the stuffable toy 100. FIG. 5G illustrates the appendages 120, 122 controlling the chamber 112 fully extended away from the body of the stuffable toy 100. FIG. 5H illustrates the stuffable toy 100 in a stuffed condition with the chamber opening 113 in a closed position with the appendages 120, 122 extending further down the body 110 of the stuffable toy 100 (as compared to FIG. 5A).

As will be appreciated by those skilled in the art, the chamber 112 can be positioned on a front surface of the stuffable toy 100 or the back surface. Additionally, a first chamber can be controllable by a first pair of appendages, and a second chamber can be controllable by a second pair of appendages and so on. Where more than one chamber is provided, the chambers can be positioned adjacent one another or partially overlapping. As noted above, other toy designs can be employed without departing from the scope of the disclosure including, but not limited to, for example, doll, cat, rabbit, turtle, lady bug, bear, and elephant.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the claims define the scope of the invention and that methods and structures within the scope of these claims and their equivalents be covered thereby.

What is claimed:

1. A stuffable toy comprising:

a textile outer sheath having a first side, a second side, and a hollow inner cavity between the first side and the second side, the textile outer sheath formed to substantially define a shape of the stuffable toy;

a first panel attached to the first side of the textile outer sheath having a non-attached edge that defines a first opening forming a first pocket;

a controller connected at a first end to a first interior location within a first appendage of the stuffable toy and connected at a second end to a second interior location within a second appendage of the stuffable toy; and a channel positioned at least partially within the first panel at a location near the first opening, wherein the controller passes partially through the channel and is operable to change a size of opening to the first pocket when appendages are pulled away from a central axis.

2. The stuffable toy of claim 1, wherein the stuffable toy is an animal chosen from a group comprising an aardvark, an alligator, an American bison, a buffalo, an anteater, an antelope, an ape, an armadillo, a donkey, a baboon, a badger, a barracuda, a bear, a beaver, a bee, a bison, a boar, a bunny, a camel, a caribou, a cat, a cheetah, a chimpanzee, a chinchilla, a cow, a coyote, a deer, a dog, a dogfish, a dolphin, a donkey, an elephant, an elk, a fox, frog, a panda, a giraffe, a goat, a gorilla, a hippopotamus, a horse, a human, a hyena, a jackal, a jaguar, a kangaroo, a koala, a lemur, a leopard, a lion, a llama, a meerkat, a mink, a monkey, a moose, a mouse, a mule, an ox, a panther, a penguin, a pig, a pony, a rabbit, a raccoon, a ram, a rat, a red deer, a reindeer, a rhinoceros, a squirrel, a tiger, a wolf, wombat, a yak, and a zebra.

3. The stuffable toy of claim 1 wherein the controller comprises a ribbon, a rope, a fabric tie, a cord, an elastic cord, a fiber, or a twine.

4. The stuffable toy of claim 1 further comprising a loop.

5. The stuffable toy of claim 1 wherein the textile outer sheath is selected from one or more of cloth, leather, suede, plush, fustian, velvet, mohair, worsted yarn, silk, cotton, polyester, terry cloth, Lycra, neoprene, and fleece.

6. The stuffable toy of claim 1 further comprising a second controller.

7. The stuffable toy of claim 6 further comprising a second channel operable to secure the second controller.

8. A method of stuffing a stuffable toy comprising:

providing a stuffable toy having a textile outer sheath having a first side, a second side, and a hollow inner cavity between the first side and the second side, the textile outer sheath formed to substantially define a shape of the stuffable toy, a first panel attached to the first side of the textile outer sheath having a non-attached edge that defines a first opening forming a first cavity, a controller connected at a first end to a first interior location within a first appendage of the stuffable toy and connected at a second end to a second interior location within a second appendage of the stuffable toy, and a channel positioned at least partially within the first panel at a location near the first opening, wherein the controller passes partially through the channel and is operable to change a size of opening to a first pocket when appendages are pulled away from a central axis;

selecting one or more items to be placed in the first cavity;

placing the one or more items into the first cavity;

pulling the first appendage and the second appendage in opposite directions away from a central axis of the stuffable toy; and reducing the size of the opening to the first cavity.

9. The method of stuffing the stuffable toy of claim 8, wherein the stuffable toy is an animal chosen from a group comprising an aardvark, an alligator, an American bison, a buffalo, an anteater, an antelope, an ape, an armadillo, a donkey, a baboon, a badger, a barracuda, a bear, a beaver, a bee, a bison, a boar, a bunny, a camel, a caribou, a cat, a cheetah, a chimpanzee, a chinchilla, a cow, a coyote, a deer, a dog, a dogfish, a dolphin, a donkey, an elephant, an elk, a fox, frog, a panda, a giraffe, a goat, a gorilla, a hippopotamus, a horse, a human, a hyena, a jackal, a jaguar, a kangaroo, a koala, a lemur, a leopard, a lion, a llama, a meerkat, a mink, a monkey, a moose, a mouse, a mule, an ox, a panther, a penguin, a pig, a pony, a rabbit, a raccoon, a ram, a rat, a red deer, a reindeer, a rhinoceros, a squirrel, a tiger, a wolf, wombat, a yak, and a zebra.

10. The method of stuffing the stuffable toy of claim 8, wherein the controller comprises a ribbon, a rope, a fabric tie, a cord, an elastic cord, a fiber, or a twine.

11. The method of stuffing the stuffable toy of claim 8 further comprising a loop.

12. The method of stuffing the stuffable toy of claim 8 wherein the textile outer sheath is selected from one or more of cloth, leather, suede, plush, fustian, velvet, mohair, worsted yarn, silk, cotton, polyester, terry cloth, Lycra, neoprene, and fleece.

13. The method of stuffing the stuffable toy of claim 8 further comprising a second controller.

14. The method of stuffing the stuffable toy of claim 13 further comprising a second channel operable to secure the second controller.

* * * * *